US012679617B2

(12) United States Patent
Durivage

(10) Patent No.: US 12,679,617 B2
(45) Date of Patent: Jul. 14, 2026

(54) PACKAGING AND HOLDER FOR A USB STICK

(71) Applicant: Pierre-André Durivage, Sainte-Adèle (CA)

(72) Inventor: Pierre-André Durivage, Sainte-Adèle (CA)

( * ) Notice: Subject to any disclaimer, the term of this patent is extended or adjusted under 35 U.S.C. 154(b) by 0 days.

(21) Appl. No.: 18/636,625

(22) Filed: Apr. 16, 2024

(65) Prior Publication Data

US 2024/0343462 A1 Oct. 17, 2024

(30) Foreign Application Priority Data

Apr. 17, 2023 (GB) ..... 2305622

(51) Int. Cl.
*B65D 73/00* (2006.01)
*B65B 5/04* (2006.01)
*B65B 7/20* (2006.01)

(52) U.S. Cl.
CPC ..... *B65D 73/0078* (2013.01); *B65B 5/04* (2013.01); *B65B 7/20* (2013.01)

(58) Field of Classification Search
CPC .... B65D 73/0078; B65D 85/546; B65B 5/04; B65B 7/20; G11B 33/04
USPC ..... 206/305, 307, 312, 320, 525.1; 281/31; 493/395
See application file for complete search history.

(56) References Cited

U.S. PATENT DOCUMENTS

| | | | | |
|---|---|---|---|---|
| 5,716,075 | A * | 2/1998 | Evert, Jr. | B42D 3/00 281/31 |
| 7,753,199 | B2 * | 7/2010 | Pignotti | H05K 5/0278 206/307 |
| 8,967,454 | B2 * | 3/2015 | Olsen | B42F 7/06 229/72 |
| 10,959,461 | B2 * | 3/2021 | Fath | B65D 85/10 |
| 2009/0165343 | A1 * | 7/2009 | Miller | G06Q 30/02 40/124.06 |
| 2009/0187692 | A1 * | 7/2009 | Czarnek | G06F 13/409 710/300 |
| 2012/0267265 | A1 * | 10/2012 | Hunter | B42D 15/045 206/232 |

* cited by examiner

*Primary Examiner* — Luan K Bui

(57) ABSTRACT

The present invention relates to a packaging apparatus specifically designed for housing a USB stick. The apparatus is crafted from a single sheet of cardboard and includes a holder, a front cover, a rear cover, and a spine, all integrally formed to create a unified, book-like structure. The holder features a recessed area that closely conforms to the dimensions of the USB stick, equipped with mechanical securing features to ensure the USB stick remains securely in place. The front and rear covers are designed to attach to the holder and include areas for displaying branding, product specifications, and graphics. This invention offers a sustainable, cost-effective solution for USB stick packaging, enhancing user interaction while ensuring optimal protection and presentation.

6 Claims, 6 Drawing Sheets

PACKAGING AND HOLDER FOR A USB STICK

CROSS-REFERENCE TO RELATED APPLICATIONS

The present application claims priority to UK application number GB2305622.9, filed on Apr. 17, 2023, the disclosure of which is hereby incorporated in its entirety at least by reference.

BACKGROUND OF THE INVENTION

1. Field of the Invention

The present invention relates generally to packaging but more particularly to a packaging solution that acts both as packaging and a holder for a USB stick.

2. Description of Related Art

In the digital age, the decline of physical media like CDs has shifted the music industry towards online sales and downloads. However, a niche market remains for physical media enthusiasts who prefer tangible ownership of digital content. Traditional physical media like vinyl and CDs or DVD and BluRay™ for visual media, provided a tangible, artistically expressive format that enhanced the consumer's experience, something that modern digital storage devices like USB sticks and SD cards lack due to their utilitarian design. Current packaging solutions for USB sticks and similar digital storage media are predominantly functional with minimal aesthetic appeal or additional utility. These existing solutions do not address the consumer's desire for a physical representation of digital purchases that parallels the artistically enriched experience offered by older media formats.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present invention to provide a packaging and holder for a USB stick in a secure manner. It is another object of the present invention to enabled a USB stick or other data device to be inserted into a cardboard packaging medium, wherein the USB stick contains audio or video recordings of performers intended for the promotion and public or private sale of their performances. Finally it is an objection of the present invention to provide a cardboard based container that opens like a book and is configured to have graphics on the front, text and visual elements on the back as well as additional text and visual elements inside.

In order to do so, the present invention provides a method of packaging a USB stick for distribution, comprising steps (a) providing a holder configured to receive and secure the USB stick, wherein the holder comprises a recessed area shaped to conform closely to the exterior dimensions of the USB stick; (b) inserting the USB stick into the recessed area of the holder; (c) securing and stopping the USB stick within the holder by engaging a stopper mechanism integrated within the holder; (d) attaching a cover to the holder, the cover being configured to protect the USB stick from environmental elements and to provide informational content related to the USB stick; and, (e) sealing the combination of the holder and cover to create a package ready for distribution.

In another aspect of the invention, a packaging apparatus for a USB stick is provided, comprising a holder having a recessed area configured to closely conform to the exterior dimensions of the USB stick, wherein the USB stick is configured to rest within the holder by engaging a stopper mechanism integrated within the holder; a cover attachable to the holder, configured to protect the USB stick from environmental elements and provide informational content related to the USB stick; and, a seal integrating the holder and cover to form a unitary package suitable for distribution.

In one embodiment, the cover is constructed from cardboard. In another embodiment, the cover includes graphics related to the contents on the USB stick.

In yet another aspect of the invention, a packaging and holder apparatus for a USB stick is provided, comprising a front cover configured for graphics, branding, and product specifications; a rear cover designed to complement the front cover in protecting the USB stick from environmental elements; a spine portion, connecting the front cover and the rear cover, facilitating a book-like opening and closing operation; a recessed area configured to closely conform to the exterior dimensions of the USB stick, mechanical securing features adapted to securely hold the USB stick within the recessed area; and, the front cover, the rear cover, the spine portion, and recessed area integrally formed from the same single sheet of cardboard, enhancing the structural integrity and sustainability of the packaging.

In one embodiment, a stopper mechanism integrated within the recessed area is provided; wherein the stopper mechanism is extracted from a cutout portion which acts as a physical barrier to keep the USB stick from sliding out from the recess unintentionally.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
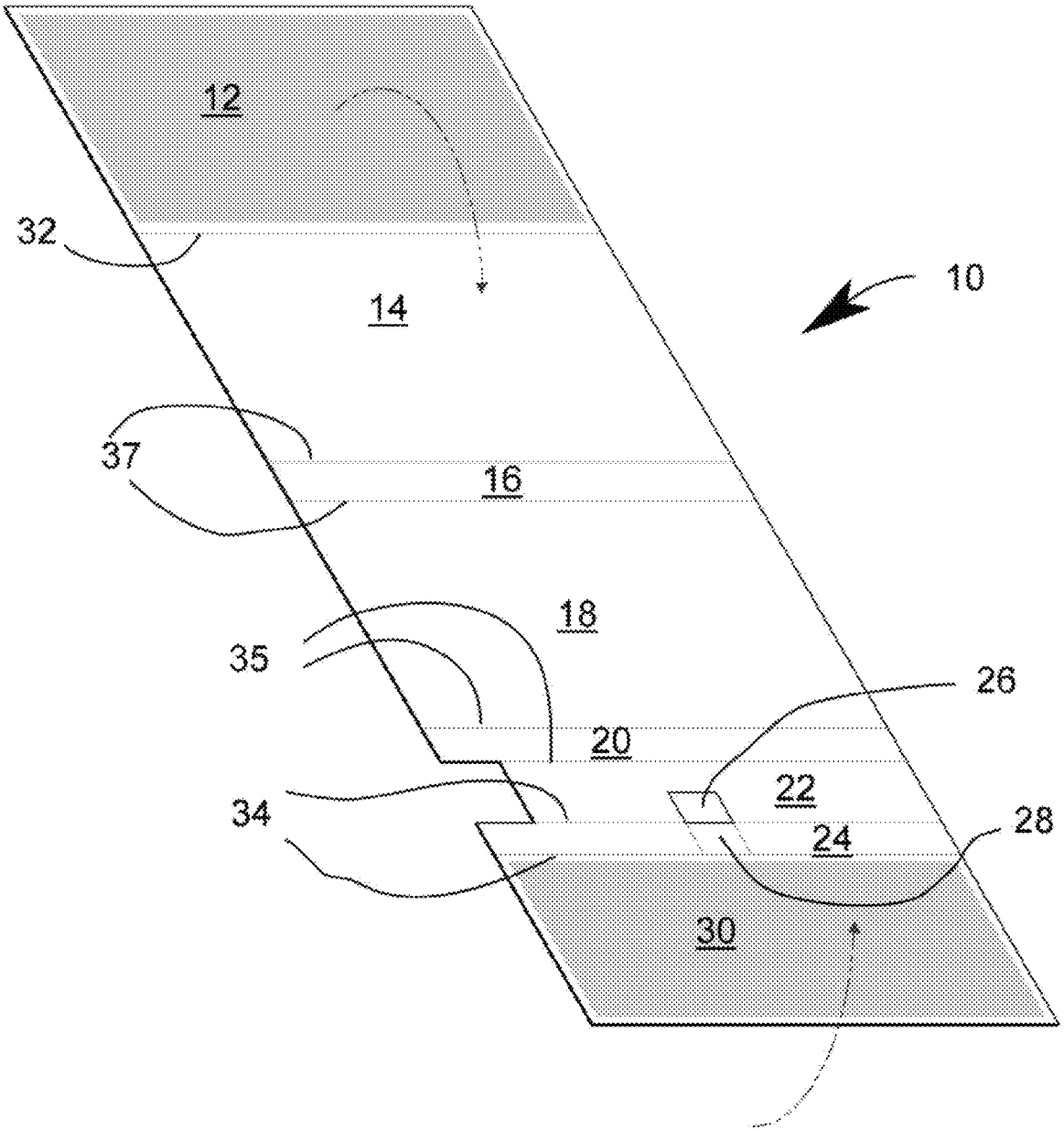
FIG. 1 is an isometric view of the packaging laid flat before assembly according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Referring now to FIGS. 1 through 6, the detailed description provided enables any person skilled in the art to make and use the invention, which encompasses the best modes contemplated by the inventor for carrying out the multifunctional packaging and holder 10 for a USB stick. This invention enhances both aesthetics and functionality, offering a unique user experience and utility.

The structural composition of the packaging and holder involves several key elements as illustrated in the figures. The rear cover portion thickener 12 and rear cover portion 14 shown in FIG. 1 contribute to the durability and stability of the packaging 10. In some embodiments, the thickener 12 is adhesively bonded to the rear cover portion 14, reinforcing the packaging's structural integrity. In some embodiments, the adhesive, is a non-toxic high strength adhesive. In some embodiments, the packaging and holder is made from a resilient, impact-absorbing material, such as cardboard. In other embodiments, the material may be selected from the group consisting of polycarbonate, ABS plastic, fiber-reinforced cardboard, and combinations thereof.

Still referring to FIG. 1, the spine portion 16 is depicted connecting the front 18 and rear 14 cover portions, mimicking a book's spine, which allows the packaging to open and close seamlessly. This design not only facilitates easy access but also enhances the user interaction by mimicking traditional book handling, thereby bridging digital and tactile experiences.

Figure 2:
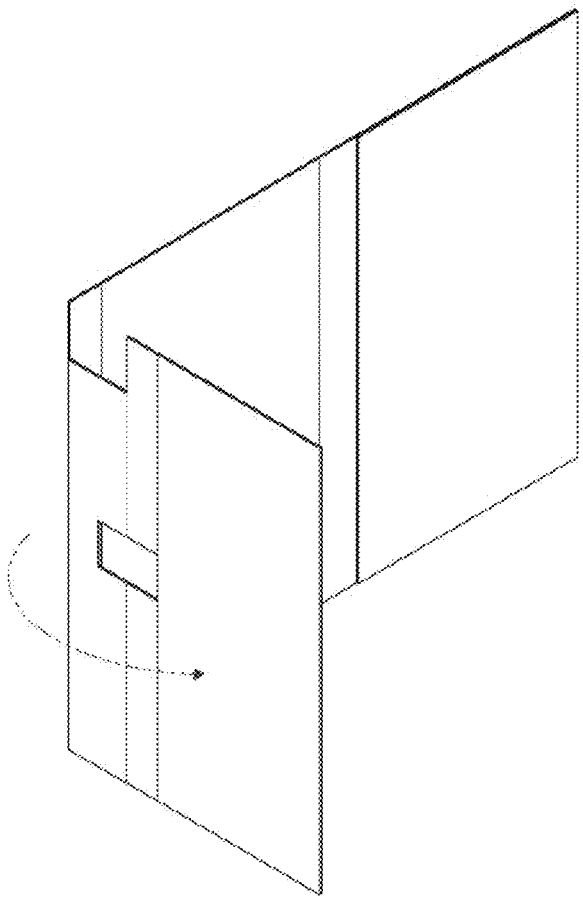
FIGS. 2-5 show isometric views of the packaging in various stages of assemble according to an embodiment of the present invention.
Figure 3:
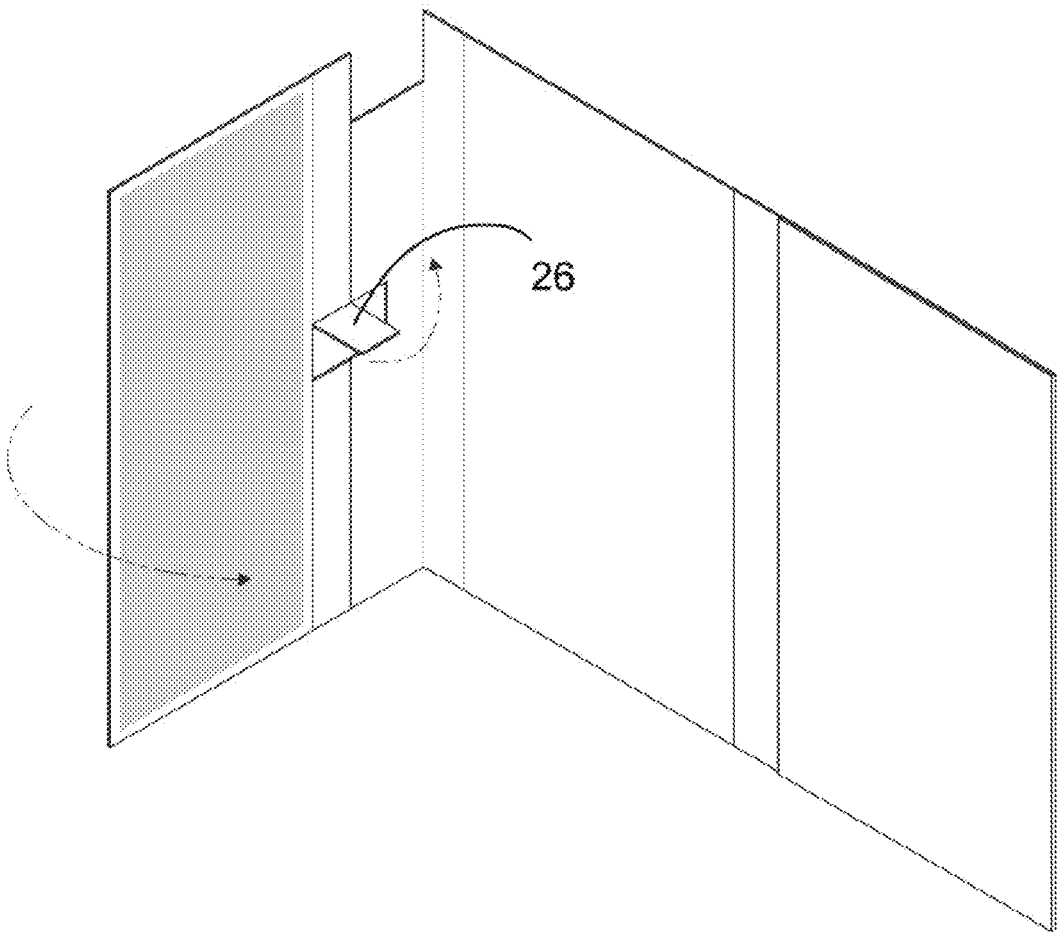
Figure 4:
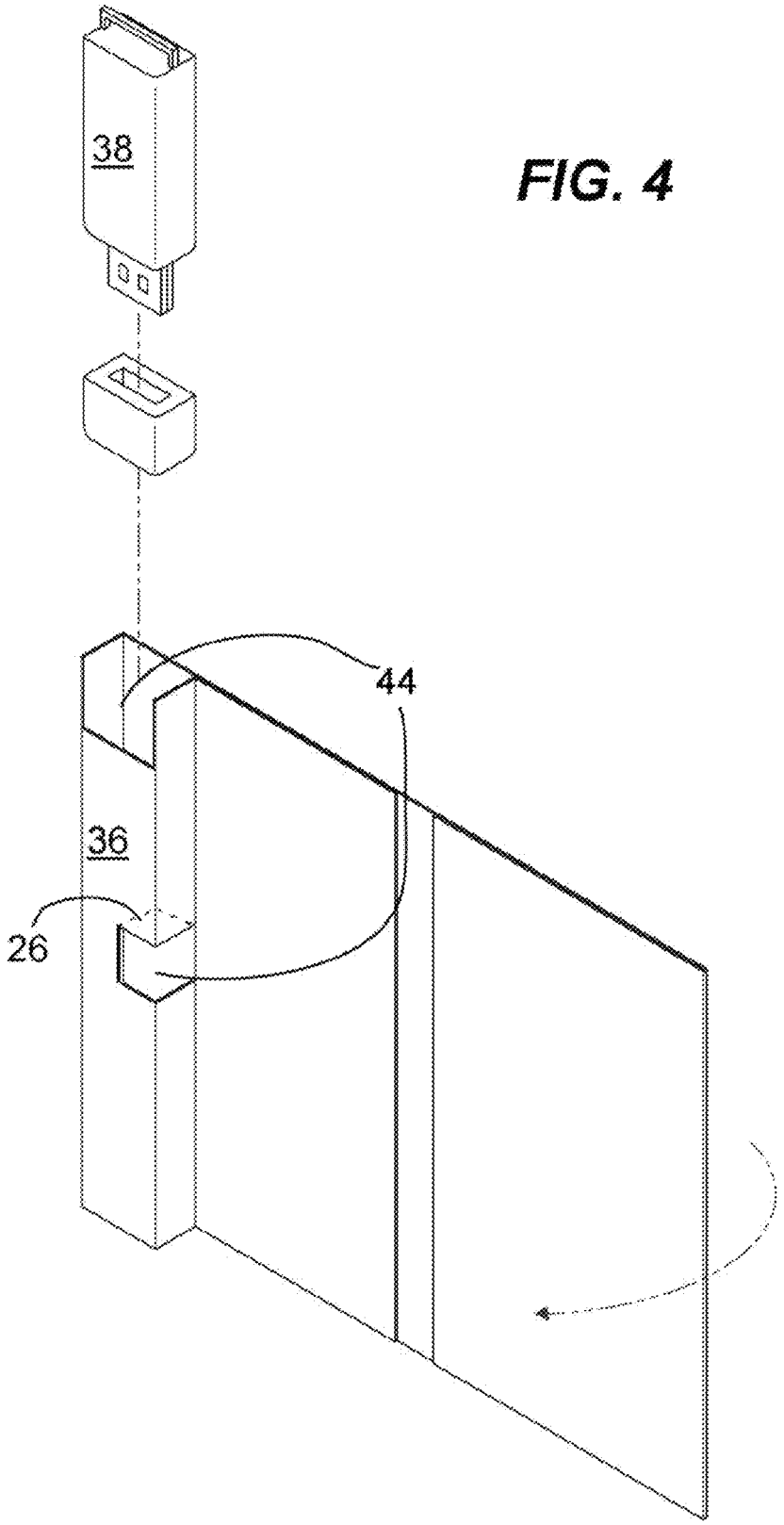

The packaging folds as shown in FIGS. 2-4, wherein the pocket Formation 36 is detailed. Advantageously, the pocket 36 is configured to securely hold a USB stick 38, ensuring it is protected and easily accessible. In some embodiments, this pocket 36 is formed by folding and gluing the first pocket side portion 20, pocket front portion 22, and second pocket side portion 24, providing a snug fit for the USB stick.

Figure 5:
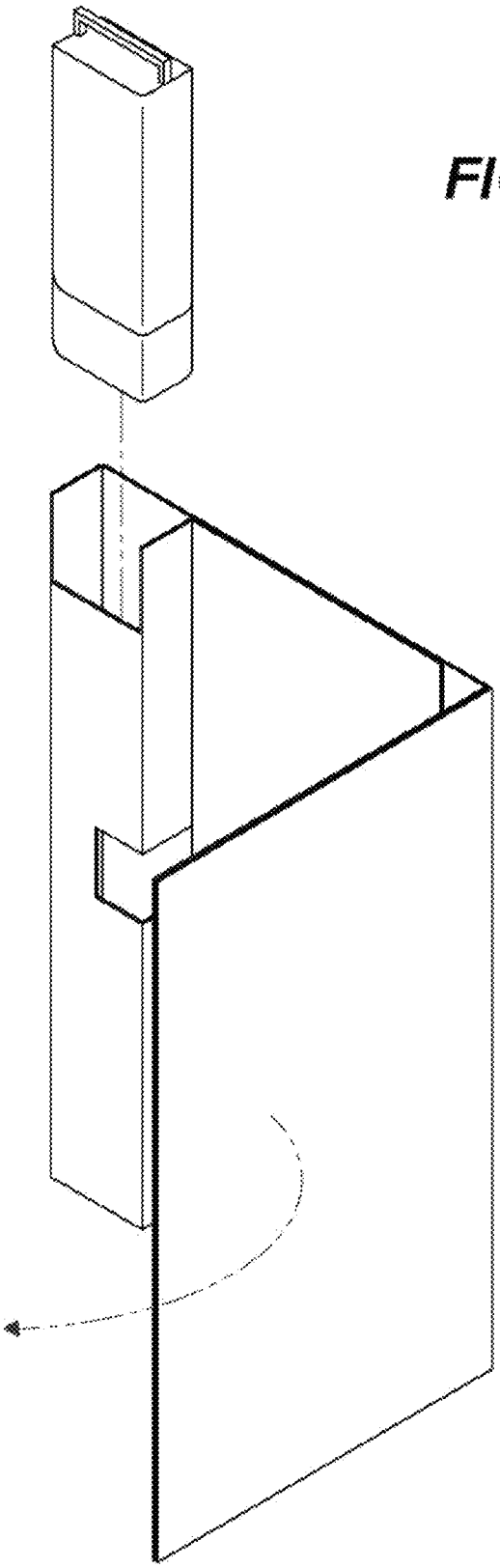

Best seen in FIG. 4, a stopper stub 26 is provided, wherein the stopper stub 26 is extracted from a cutout portion 28, which acts as a physical barrier to keep the USB stick 38 from sliding out unintentionally. This feature is crucial for securing the USB stick during transport and storage. Once the USB Stick is securely placed with the pocked 36, the front cover is folded over as illustrated in FIG. 5.

Figure 6:
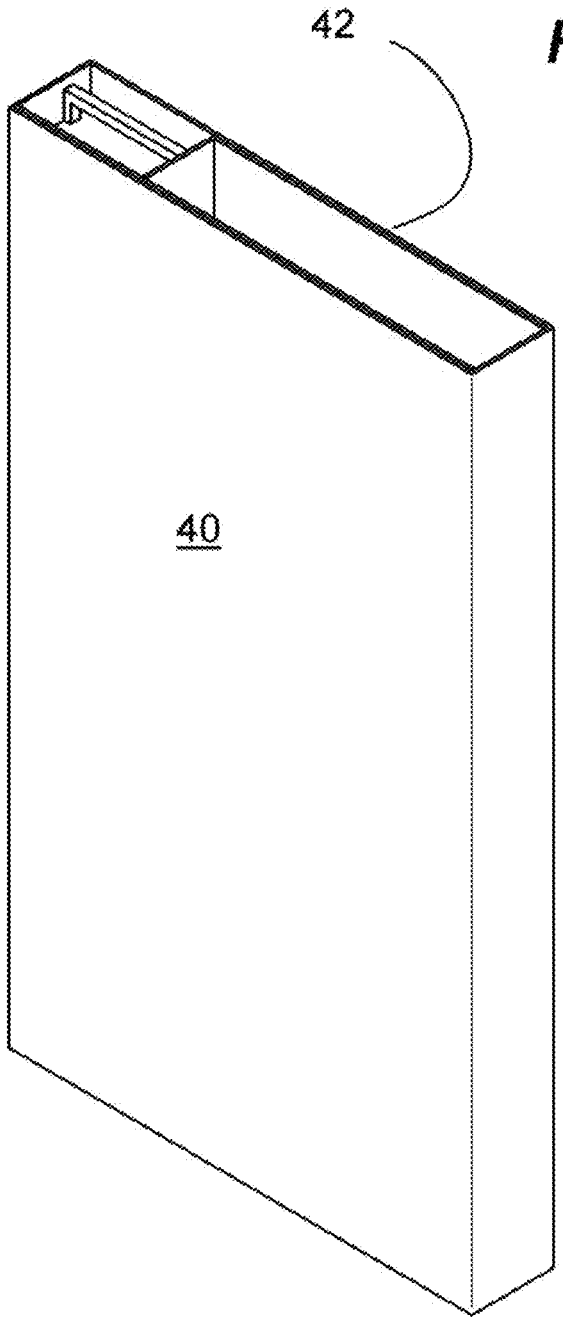
FIG. 6 is an isometric view of the packaging fully assembled according to an embodiment of the present invention.

Finally, as seen in FIG. 6, the assembly of the packaging is completed with the exterior front 40 and rear covers 42 presenting a clean and professional appearance. These covers not only protect the contents but also offer ample space for artistic and informational graphics, further enhancing the aesthetic appeal and making the packaging an integral part of the user experience. In some embodiments, adhesive or other fastening methods may be used to secure the front cover 40 to the pocket 36 to prevent unauthorized access to the USB stick.

This inventive packaging and holder system provides a sophisticated, secure, and aesthetically pleasing solution for handling digital storage devices like USB sticks, making it a valuable product for consumers seeking a more engaging way to store and present their digital content. It should be noted that the rear cover portion 14 and the front cover portion 18 form the interior faces of the packaging 10. As best seen in FIG. 6, both covers 14, 18 have their opposite sides as exterior front cover 40, and exterior rear cover 42.

In use, the buyer opens the packaging 10 and takes the USB stick 38 out of the pocket 36 and inserts it in a USB slot in an appropriate computer device (not shown). Openings 44 in the pocket 36 make it easier for a user to take the USB stick 38 out. In some embodiments, as well known in the art art, built-in software asks for an unlock code. This code is printed inside the packaging 10. Once the code is accepted, the software unlocks the contents of the USB stick 38. If desired, the user can then download it onto his device and can erase the contents from the USB stick 38 so as to use it for other data.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For example, other data devices, such as an SD card may be substituted for the USB stick.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A method of packaging a USB stick for distribution, comprising:

providing a USB holder and cover constructed from a single rectangular sheet of foldable material having a height and width, the single rectangular sheet of foldable material comprising one side having a recessed portion;

the material including a rear cover portion, adjacent to a spine portion, adjacent to a front cover portion, adjacent to a first pocket side portion, adjacent to a pocket front portion having the recessed portion and a first cutout opening near its a middle portion of the height corresponding to a length of the USB stick, wherein the pocket front portion is adjacent to a second pocket side portion with a second cutout opening adjacent to the first cutout opening of the pocket front portion;

providing a stopper mechanism extracted from a cutout portion of the second cutout opening;

forming the USB holder and cover by folding the single rectangular sheet of foldable material at fold lines between each portion, wherein the holder comprises a recessed area shaped to conform closely to the exterior dimensions of the USB stick;

inserting the USB stick into the recessed area of the holder, securing and stopping the USB stick within the holder by engaging the stopper mechanism integrated within the holder;

attaching and sealing the cover to the holder, via an adhesive to create a package ready for distribution.

2. A packaging apparatus for a USB stick, comprising:

a holder having a recessed area configured to closely conform to the exterior dimensions of the USB stick, wherein the holder is integrally formed from a single rectangular sheet of foldable material comprising one side having a recessed portion, wherein the USB stick is configured to rest within the holder by engaging a stopper mechanism integrated within the holder, an opening in the holder adjacent to the stopper mechanism, wherein the stopper mechanism is oriented in a horizontal plane orthogonal to a vertical plane of the opening;

a cover attachable to the holder, configured to protect the USB stick from environmental elements and provide informational content related to the USB stick, wherein the cover includes a front portion and a rear portion which each comprise a single flat plane; and, a seal integrating the holder and cover to form a unitary package suitable for distribution.

3. The packaging apparatus of claim 2, wherein the holder and cover are constructed from a rigid material.

4. The packaging apparatus of claim 2, wherein the cover includes graphics related to the contents on the USB stick.

5. A packaging and holder apparatus for a USB stick, comprising:

a front cover comprising a single flat plane configured for graphics, branding, and product specifications;

a rear cover comprising a single flat plane designed to complement the front cover in protecting the USB stick from environmental elements;

a spine portion, connecting the front cover and the rear cover, facilitating a book-like opening and closing operation;

a recessed area configured to closely conform to the exterior dimensions of the USB stick, a stopper mechanism adapted to securely hold the USB stick within the recessed area, and an opening in the holder adjacent to the stopper mechanism, wherein the stopper mechanism is oriented in a horizontal plane orthogonal to a vertical plane of the opening;

the front cover, the rear cover, the spine portion, and recessed area integrally formed from a single rectangular sheet of cardboard comprising one side having a recessed portion, enhancing the structural integrity and sustainability of the packaging; and, wherein the recessed area is located on a side of the packaging and holder apparatus adjacent to a single larger rectangular void area between the front cover and the back cover and the spine, and the USB stick is positioned within a top section of the recessed area and therefore the USB stick is positioned within a corner section of the packaging and holder apparatus.

6. The packaging and holder apparatus for a USB stick of claim 5, further comprising the stopper mechanism integrated within the recessed area; wherein the stopper mechanism is extracted from a cutout portion which acts as a physical barrier to keep the USB stick from sliding out from the recess unintentionally.

* * * * *